United States Patent [19]

Lindstrom et al.

[11] Patent Number: 4,459,158

[45] Date of Patent: Jul. 10, 1984

[54] SULFUR BASED METAL CLEANERS

[75] Inventors: Merlin R. Lindstrom; Donald H. Kubicek, both of Bartlesville, Okla.

[73] Assignee: Phillips Petroleum Company, Bartlesville, Okla.

[21] Appl. No.: 427,224

[22] Filed: Sep. 29, 1982

[51] Int. Cl.[3] ..... C11D 7/06

[52] U.S. Cl. ..... 134/3; 134/2; 252/142; 252/146; 252/151; 252/156; 252/395; 252/396

[58] Field of Search ..... 252/142, 146, 151, 156, 252/395, 396; 562/594, 512; 560/152, 154, 147; 260/399; 134/2, 3

[56] References Cited

U.S. PATENT DOCUMENTS

| | | | |
|---|---|---|---|
| 2,398,202 | 4/1946 | Zublin et al. | 252/395 |
| 2,947,599 | 8/1960 | Ennis | 252/395 |
| 3,094,490 | 6/1963 | Gardner et al. | 252/151 |
| 3,494,947 | 2/1970 | Schutze et al. | 560/154 |
| 3,518,098 | 6/1970 | Ford et al. | 252/395 |
| 3,741,909 | 6/1973 | Yamane et al. | 562/512 |

FOREIGN PATENT DOCUMENTS

| | | |
|---|---|---|
| 49-108138 | 4/1974 | Japan . |
| 52-27401 | 3/1977 | Japan . |
| 53-104932 | 3/1978 | Japan . |

*Primary Examiner*—John E. Kittle
*Assistant Examiner*—Hoa Van Le

[57] ABSTRACT

A novel composition and process are provided for cleaning metallic steel surfaces. The aqueous cleaning composition comprises effective amounts of a metal hydroxide, a water soluble surfactant and at least one sulfur containing compound selected from the group consisting of a thioalkanoic compound or a dithiobis (alkanoic) compound. A thioalkanoic compound represented by:

R—S—R—COOH and a dithiobis (alkanoic) compound represented by

R'OOC—R—$(S)_n$—R—COOR' wherein R is any divalent hydrocarbon radical having from 1 to 8 carbon atoms, R' is hydrogen or any alkyl radical having from 1 to 4 carbon atoms, and n can be 1, 2, or 3.

9 Claims, No Drawings

SULFUR BASED METAL CLEANERS

This invention relates to the cleaning of metal surfaces.

The surface cleanliness of metal surfaces is known to influence the physical and chemical properties of that surface. The surfaces of most metallic materials are covered either by a metal oxide due to oxidation, organic residues from the annealing process, or protective oils applied during a fabrication process. It is known to those skilled in the art that it is advantageous to remove these materials from the metal surface prior to subsequent handling such as, for example, a coating processes in order to obtain the maximum benefit from the coating.

Cleaning of metal surfaces is a laborious task at best. Cleaning agents for metallic surfaces of various types have been suggested, such as grinding compounds containing abrasives, corrosive and toxic materials like acid, and sometimes a chemical additive which has not necessarily assisted the cleaning process. For example, high molecular weight long chain alkyl mercaptans have been used in such formulations. Unfortunately, as chemical additives, these mercaptans leave an objectionable greasy film on the surface of the metal. In addition, many of these compounds are malodorous.

Of course, the use of abrasives, generally is undesirable. The metal surface, must, perforce, be worn away to at least a slight extent, at each and every abrading. In time this depreciates the value of the article involved, particularly plated ones. The abrading itself, even with finely divided abrasives, tends to increase the total surface area of the metal exposed to the corrosion causing environment. The same is true when corrosive and toxic materials are used.

An effective class of cleaning agents is certainly to be desired to remove contamination from common metal surfaces such as steel.

It is an object of this invention to provide novel compositions suitable for cleaning steel surfaces. It is a further object of this invention to provide a process for the cleaning of steel surfaces.

Other aspects, objects, and the several advantages of this invention will be obvious to one skilled in the art to which our invention most nearly pertains from the following description and from the appended claims.

In accordance with the present invention it has been discovered that certain sulfur containing compounds are unusually effective agents for the removal of contaminants from steel surfaces. More particularly, thioalkanoic and dithiobis (alkanoic) compounds have been found to be unusually effective cleaning agents for steel surfaces while only the former effective also on copper and brass.

The thioalkanoic compounds useful within the context of this invention can be represented by the generalized formula $$R—S—R—COOH \quad (I)$$

and the dithiobis (alkanoic) compounds represented by the generalized formula $$R'OOC—R—(S)_n—R—COOR' \quad (II)$$

where R is any divalent hydrocarbon radical having from 1 to 8 carbon atoms, R' is hydrogen or any alkyl radical having from 1 to 4 carbon atoms, and n can be 1, 2, or 3.

Compounds falling under formula I useful within the practice of this invention include:

Methylthioacetic Acid
Ethylthioacetic Acid
Butylthioacetic Acid
Tertiary-Butylthioacetic Acid
Tertiary-Butylthiopropionic Acid
Tertiary-Butylthiocaprylic Acid
Octylthiocaprylic Acid
and mixtures thereof.

Compounds falling under formula II which are useful in the practice of the present invention include:

Thiodiacetic Acid
3,3'-Thiodipropionic Acid
8,8'-Thiodicaprylic Acid
3,3'-Dithiodipropionic
3,3'-Trithiodipropionic Acid
Thiobis(methylacetate)
Thiobis(propylacetate)
3,3'-Thiobis(methylpropionate)
3,3'-Dithiobis(methylpropionate)
4,4'-Dithiobis(ethylbutyrate)
and mixtures thereof.

In the case of each type of compound indicated above (I and II), a general maximum total number of carbon atoms per individual compound upper limit is dictated primarily by upper feasible solubility limits of the individual compounds in the applications and processes according to the present invention.

The compounds of the present invention can be prepared by reacting an alkyl mercaptan or hydrogen sulfide with an alpha-unsaturated alkyl alkenoate according to a general method described in U.S. Pat. No. 4,224,436. Subsequent hydrolysis yields the corresponding acid.

The aqueous cleaning composition of the present invention will comprise effective amounts of at least one sulfur containing compound as described above, at least one Group IA or IIA metal hydroxide, and at least one water soluble surfactant. Any water soluble surfactant can be used in the present invention. However, an anionic surfactant such as an alkyl aryl sulfonate is typically used.

An effective amount of each of the above ingredients is defined, for the purposes of this invention, to be that amount of the ingredient necessary to effectuate proper cleaning of the metal surface involved. It is contemplated in the present invention that the effective amount of each ingredient needed will vary from composition to composition depending upon the particular steel surface to be cleaned.

Generally, the aqueous cleaning composition will comprise from about 80.0 to 99.55 weight percent water, from about 0.1 to 5.0 weight percent water soluble surfactant, from about 0.1 to about 5.0 weight percent Group IA or IIA metal hydroxides, and from about 0.25 to about 10.0 weight percent of at least one of the sulfur containing compounds described above.

In the process of the present invention, the contaminated steel surface is cleaned by contacting the surface with the cleaning composition described earlier. Samples of steel such as steel coupons can be immersed in any type of agitated bath, such as an ultrasonic bath, consisting of the ingredients described above, i.e., water and at least one sulfur containing compound, a Group IA or IIA metal hydroxide, and a water soluble surfactant. This combination of metal coupons and cleaning solution can then be stirred and heated at any temperature and for any time suitable to effectuate proper cleaning. Typically the metals are heated in a cleansing solution at a temperature between about 70° to 200° F. for no longer than about 15 minutes. By the process of the present invention, the resulting metal surfaces should be substantially free of contaminants.

The following Example further illustrates the present invention.

EXAMPLE

This example serves to illustrate the operability of this invention using thio- or dithio-bis alkanoic acids and esters as the active ingredient in aqueous metal surface cleaning solutions. The test used to evaluate these compounds consists of immersing 1 inch×5 inch×0.400 inch steel, 1 inch×5 inch×0.035 inch brass, and 1 inch×5 inch×0.025 inch copper coupons into an aqueous cleaning solution containing 1 weight percent sodium hydroxide, or 1 weight percent surfactant (Triton X-202, a sodium alkylaryl polyether sulfonate), or 2 weight percent of the active sulfur-based ingredient, or combinations of all three. The solutions were heated to 90° F., 140° F., or 190° F. and stirred in an ultrasonic bath. The uncleaned metal coupons were periodically removed from the bath, rinsed in running tap water, visually rated for appearance, and evaluated for cleanliness by the water break-free test. This test is discussed in Metal Finishing 45 (12), pg. 77, 78, 88 (1947), "Testing of Alkaline Metal Cleaners" by A. Mankowich and Organic Finishing, "Method of Evaluating Alkali Cleaners", 1946, pg. 9 by C. Nielson. Water break-free test means the surface remains water-wetted without breaking away. At this point the surface is considered clean. The surfaces were also examined for general cleaning in addition to water break-free. Using the procedure described a number of thio acids and esters were evaluated as active ingredients in a typical aqueous cleaning solution. The data listed in Table I show that in general the solutions are useful primarily on steel surfaces. The esters such as 3,3'-thiobis(methylpropionate) and 3,3'-dithiobis(methylpropionate) appear to be slightly more effective in cleaning steel surfaces than the thio acids like 3,3'-thiodipropionic acid and tertiary-butylthioacetic acid. Based on the results found, it appears the most effective sulfur-based ingredient is 3,3'-dithiobis(methylpropionate). None of the ingredients were particularly effective when used in the absence of a surfactant and sodium hydroxide.

TABLE I

Effect of Thio- and Dithio- Alkanoic Acids and Esters as Aqueous Cleaning Solution Ingredients

| | Minutes Till Cleaning and/or Break-Free[a] | | | | | | | | |
|---|---|---|---|---|---|---|---|---|---|
| | Brass | | | Copper | | | Steel | | |
| Cleaning Solution | 90° F. | 140° F. | 190° F. | 90° F. | 140° F. | 190° F. | 90° F. | 140° F. | 190° F. |
| Controls: | | | | | | | | | |
| 1. 1% Aq. NaOH | ← | → | | NSC[b], Discolors | | | ← | → | |
| 2. 1%, Aq. Triton X-202[c] | ← | → | | NSC, Discolors | | | ← | → | |
| 3. 1% Aq. NaOH, 1% Aq. Triton X-202 | ← | → | | NSC, Discolors | | | ← | → | |
| 4. 2% TBP Ester[d], 1% Aq. Triton X-202 | ← | → | | NSC | | ← | → | | |
| 5. 2% DTBP Ester[e] | 15 | 15 | 15 | 15 | 15 | 15 | 15 | 15 | |
| 6. 2% TDPA[f], 1% Triton X-202 | 15 | 15 | 15 | 15 | 15 | 15 | 15 | 15 | 15 |
| 7. 2% t-BTA[g], 1% Triton X-202 | ← | → | | NSC | | ← | → | | |
| Inventive Runs: | | | | | | | | | |
| 8. 2% TBP Ester[d], 1% Aq. Triton X-202, 1% Aq. NaOH | 3 | 1 | 1 | >15 | >15 | >15 | 5 | 3 | 1 |
| 9. 2% DTBP Ester[e], 1% Aq. Triton X-202, 1% Aq. NaOH | >15 | (not clean) 3 | 3 | 5 | 3 | 3 | 1 | 1 | 1 |
| 10. 2% TDPA[f], 1% Aq. Triton X-202, 1% Aq. NaOH | 15 | (not clean) 15 | 15 | 15 | (not clean) 15 | 15 | 15 | 15 | 15 |
| 11. 2% t-BTA[g], 1% Triton X-202, 1% Aq. NaOH | ← | → | | NSC | ← | → | 5 | 5 | 5 |

[a]Break-free means the surface remains water-wetted without breaking away.
[b]Means no significant change.
[c]An anionic surfactant identified as an alkylaryl polyether sulfonate from Rohm and Hass.
[d]3,3'-Thiobis(methylpropionate).
[e]3,3'-Dithiobis(methylpropionate).
[f]3,3'-Thiodipropionic Acid.
[g]Tertiary-butylthioacetic Acid.

Certainly reasonable variations and modifications are possible within the scope of this disclosure, yet without departing from the reasonable scope and certainly not from the intended spirit thereof, as shown by the specification itself, including the claims here appended.

We claim:

1. A process for the cleaning of metallic steel surfaces which comprises bringing said metallic steel surfaces into contact with an aqueous composition comprising effective amounts of at least one (a) sulfur containing compound selected from the group consisting of a thioalkanoic compound represented by:

R—S—R—COOH and a dithiobis (alkanoic) compound represented by

R'OOC—R—$(S)_n$—R—COOR' where R is any divalent hydrocarbon radical having from 1 to 8 carbon atoms, R′ is hydrogen or any alkyl radical having from 1 to 4 carbon atoms, and n can be 1, 2, or 3;

(b) Group IA or IIA metal hydroxide; and (c) water soluble surfactant.

2. A process according to claim 1 wherein said thioalkanoic compound is at least one of methylthioacetic acid, ethylthioacetic acid, butylthioacetic acid, tertiary-butylacetic acid, and tertiary-butylpropionic acid.

3. A process according to claim 1 wherein said dithiobis (alkanoic) compound is at least one of thiodiacetic acid, 3,3′-thiodipropionic acid, 3,3′-dithiodipropionic acid, and 3,3′-trithiodipropionic acid.

4. A process for the cleaning of metallic steel surfaces which comprises bringing said metallic steel surfaces into contact with a composition comprising:

(a) from about 80.0 to 99.55 weight percent water;

(b) from about 0.1 to 5.0 weight percent of at least one water soluble surfactant;

(c) from about 0.1 to 5.0 weight percent of at least one group IA or IIA metal hydroxide; and (d) from about 0.25 to 10.0 weight percent of at least one sulfur containing compound selected from the group consisting of a thioalkanoic compound represented by:

$$R—S—R—COOH$$

and a dithiobis (alkanoic) compound represented by $$R'OOC—R—(S)_n—R—COOR'$$

wherein R is any divalent hydrocarbon radical having from 1 to 8 carbon atoms, R′ is hydrogen or any alkyl radical having from 1 to 4 carbon atoms, and n can be 1, 2, or 3.

5. A process according to claim 4 wherein said thioalkanoic compound is at least one of methylthioacetic acid, ethylthioacetic acid, butylthioacetic acid, tertiary-butylacetic acid, and tertiary-butylpropionic acid.

6. A process according to claim 4 wherein said dithiobis (alkanoic) compound is at least one of thiodiacetic acid, 3,3′-thiodipropionic acid, 3,3′-dithiodipropionic acid, and 3,3′-trithiodipropionic acid.

7. A composition suitable as a metallic cleaning agent comprising:

(a) from about 80.0 to 99.55 weight percent water;

(b) from about 0.1 to 5.0 weight percent of at least one water soluble surfactant;

(c) from about 0.1 to 5.0 weight percent of at least one group IA or IIA metal hydroxide; and (d) from about 0.25 to 10.0 weight percent of at least one sulfur containing compound selected from the group consisting of a thioalkanoic compound represented by:

$$R—S—R—COOH$$

and a dithiobis (alkanoic) compound represented by $$R'OOC—R—(S)_n—R—COOR'$$

where R is any divalent hydrocarbon radical having from 1 to 8 carbon atoms, R′ is hydrogen or any alkyl radical having from 1 to 4 carbon atoms, and n can be 1, 2, or 3.

8. A composition according to claim 7 wherein said thioalkanoic compound is at least one of methylthioacetic acid, ethylthioacetic acid, butylthioacetic acid, tertiary-butylacetic acid, and tertiary-butylpropionic acid.

9. A composition according to claim 7 wherein said dithiobis (alkanoic) compound is at least one of thiodiacetic acid, 3,3′-thiodipropionic acid, 3,3′-dithiodipropionic acid, and 3,3′-trithiodipropionic acid.

* * * * *